United States Patent [19]

Siwerstam

[11] 4,255,924

[45] Mar. 17, 1981

[54] METHOD AND MACHINE FOR PRODUCING PIPE CLEANERS

[75] Inventor: Jan Siwerstam, Munkedal, Sweden

[73] Assignee: United States Tobacco Company, Greenwich, Conn.

[21] Appl. No.: 61,187

[22] Filed: Jul. 27, 1979

[51] Int. Cl.[3] ..... A46D 3/05; D02G 3/42

[52] U.S. Cl. ..... 57/24; 57/6; 29/780; 300/21

[58] Field of Search ..... 57/1 R, 1, 3, 12, 24, 57/203, 6; 131/170 R, 172, 184 R, 184 B, 245; 300/1, 2, 21; 29/779, 780, 417

[56] References Cited

U.S. PATENT DOCUMENTS

| | | | |
|---|---|---|---|
| 1,829,446 | 10/1931 | Hinelein | 131/245 X |
| 2,576,430 | 11/1951 | Weller | 131/245 X |
| 2,931,366 | 4/1960 | Siegel | 131/245 |
| 3,109,277 | 11/1963 | Raymond et al. | 57/24 |
| 3,330,603 | 7/1967 | Gelardi | 300/21X |
| 3,370,622 | 2/1968 | Marks | 300/21 X |
| 3,584,449 | 6/1971 | Pollard | 57/1 R |
| 3,657,870 | 4/1972 | Marks | 57/24 |
| 3,942,310 | 3/1976 | Rodermund et al. | 57/24 |
| 4,171,850 | 10/1979 | Eriksson | 57/6 X |

*Primary Examiner*—Donald Watkins
*Attorney, Agent, or Firm*—Harold L. Stults

[57] ABSTRACT

The method and apparatus for producing pipe cleaners each of which comprises two wires which have been twisted into interlocking spirals with fiber elements clamped between the wires. Two primary wires pass through a spinning head and three continuous strands of fibers are wound into spirals covering the wires. Holding wires are passed against the spiral strands upon opposite sides as the entire assembly moves between a pair of pulleys. As the assembly emerges, the fibers are cut diametrically of the spirals to form two continuous rows of fiber elements. Each row is clamped to its adjacent primary wire by a holding wire thus to form a workpiece. Each workpiece passes through a transfer assembly in which the row of fiber elements is clamped to a pulley by one of the wires while the other wire passes along a free loop around pulley and thence back to the row of fiber elements in the wire holding them. The downstream end of the workpiece is twisted and held taut as it passes from the pulley so that the two wires are twisted into spirals as they pass from the pulley.

8 Claims, 9 Drawing Figures

METHOD AND MACHINE FOR PRODUCING PIPE CLEANERS

This invention relates to manufacturing wire-fiber products each of which includes two wires which have been twisted together in continuous spirals and which clamp fiber elements between them. The invention relates particularly to a method and apparatus for producing pipe cleaners.

An object of this invention is to provide improved methods and apparatus for manufacturing pipe cleaners formed of wire-fiber assemblies. Another object is to provide improved wire-fiber assemblies of the type referred to above. A further object is to provide for the above in a manner which insures maintenance of uniform high quality. A still further object is to provide for the above with methods and machines which are adapted to be operative under various conditions of operation and use.

Pipe cleaners have been produced upon machines which form a continuous wire-fiber assembly having two wires twisted together in concentric spirals with fibers between them. That assembly is cut into lengths automatically as it emerges from a twisting head to form the individual pipe cleaners. In some such machines, two primary wires move in parallel, side-by-side relationship through a spinning head which winds a plurality of continuous strands of fibers into spirals on the wires. The wires are moved along the axis of the spirals to a cutter assembly which cuts the fibers diametrically of the axis so that each complete spiral of the fibers is formed into two fiber elements, the length of which is one-half the diameter of the spiral. That produces two continuous rows of the fiber elements upon the opposite sides of the two wires. Two holding wires move toward the cutter assembly radially inward with respect to that axis and diametrically opposite, and are pressed against the fiber spirals immediately after passing from the cutter assembly. As the fiber elements are formed, each of the holding wires clamps one row of the fiber elements against the next adjacent one of said primary wires. That forms two wire-fiber assemblies, each of which comprises one of the rows of fiber elements and one each of the primary and holding wires which clamp the row of fiber elements in a continuous array. The wire-fiber assemblies are then drawn directly to two twisting heads, one for each of said wire-fiber assemblies, and each wire-fiber assembly is held taut between the cutter assembly and its twisting head. The twisting head rotates at a predetermined rate relative to the speed of longitudinal movement of the wire-fiber assemblies so that the wires are formed into interlocking spirals of predetermined pitch and dimensions. The fibers are then locked between the spiral wires with the fiber ends projecting somewhat radially outwardly. The wires are still bendable, and the relationship is such that the fibers are held firmly during normal usage.

U.S. Pat. No. 2,576,430 discloses a "Chenille Making Machine" of the general type discussed above. With that arrangement, the twisting zone within which the twisting of the wires occurs extends from the cutting assembly directly to the twisting head. Therefore, as the cutting is taking place, the pair of wires in each wire-fiber assembly is subjected to the twisting action within the zone where the cutting is taking place. While commercially acceptable products can be produced in that manner, that mode of operation causes some difficulty in maintaining uniform high quality of the product and creates certain other problems. It is a further object of the present invention to improve the twisting action on wire-fiber assemblies, that is, the "workpieces." This is accomplished by performing the twisting in a zone which is downstream and isolated from the cutting assembly.

Referring to the drawings which show an illustrative embodiment of the invention:

Figure 1:
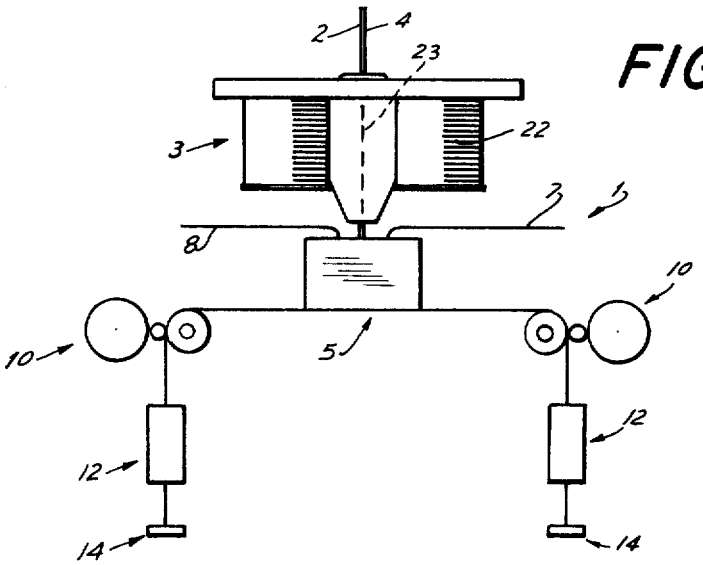
FIG. 1 is a schematic representation of the entire machine.

Referring to FIG. 1 of the drawings, a machine 1 is represented schematically and has the following components: a spinning head 3 through which a pair of primary wires 2 and 4 are drawn from reels; a cutter assembly 5 toward which a pair of holding wires 7 and 8 are drawn from reels (not shown); two transfer assemblies 10; two twisting heads 12, and cutters 14. As indicated above, the present invention comprises an improvement in the portion of known types of machines from the cutter assembly 5 to the twisting heads 12. The spinning heads, twisting heads and cutter are of known construction, illustratively as disclosed in Weller U.S. Pat. No. 2,576,430. The machine operates as explained above to produce two continuous twisted wire-fiber assemblies which are severed into lengths, each of which is a pipe cleaner.

Figure 2:
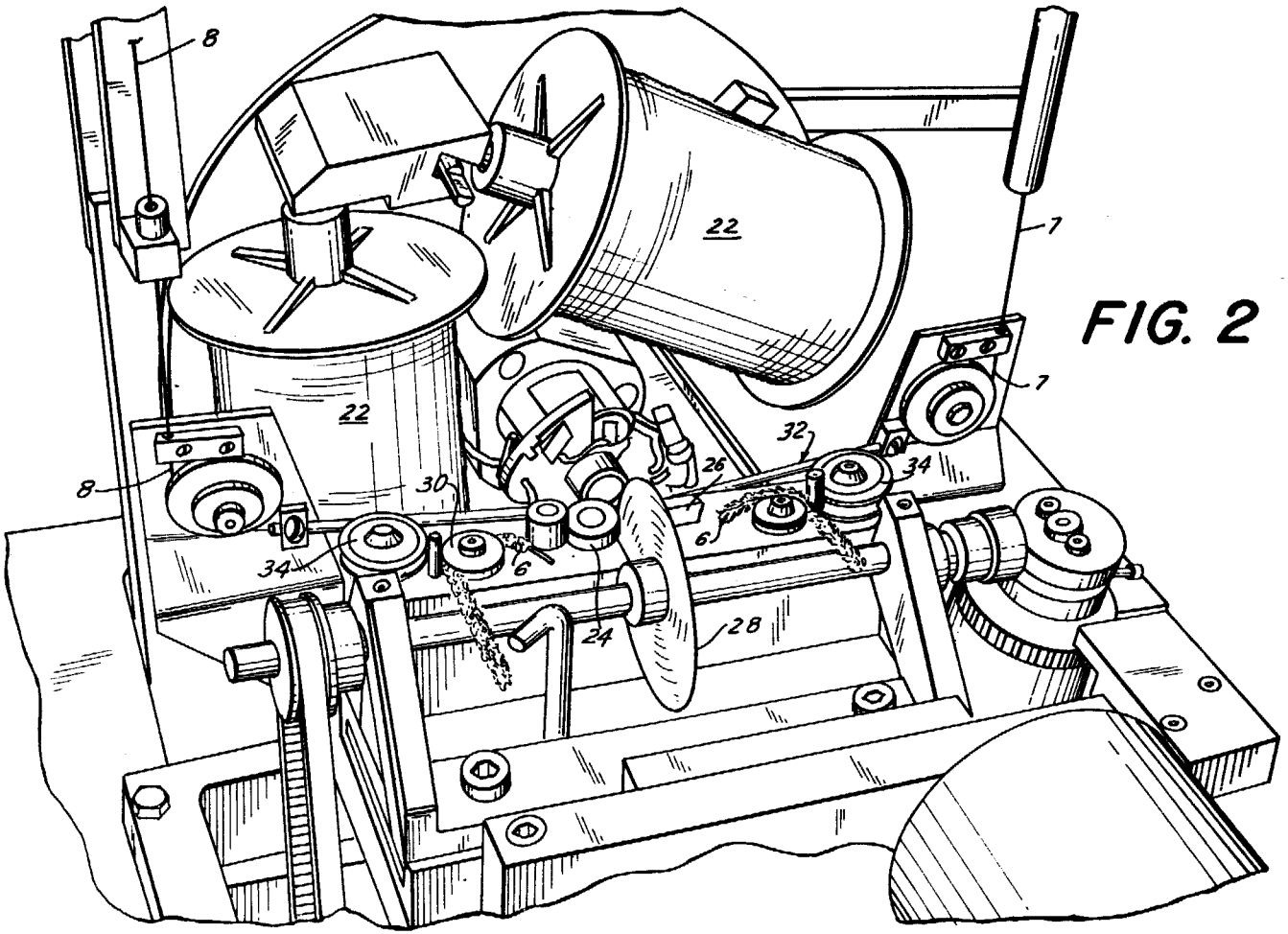
FIG. 2 is a partial front view of the main portion of the machine for producing the continuous wire-fiber assemblies.

Referring to FIG. 2 of the drawings, spinning head 3 supports three spools 22 of loose fiber strands or cord. Primary wires 2 and 4 pass through the central bore of the spinning head while the spinning head rotates about its axis 23 to wind the three fiber strands onto the wires. That forms three concentric spirals of fibers which form a tight cylindrical cover on the wires. The wires and fiber windings then pass between two vertical-axis pulleys 24 and 26 to a horizontal-axis, rotating disc knife 28 which slices the fiber spirals diametrically so as to form each individual turn of the spirals into two fiber elements 15 of predetermined length. However, as wires 2 and 4 approach knife 28, two holding wires 8 are drawn in from the opposite sides of pulleys 24 and 26 and onto the pulleys against the respective wires 2 and 4. Therefore, prior to the cutting of the fibers by knife 28, the fiber spirals are clamped upon opposite sides against the spirals of fibers against respective wires 2 and 4 by the holding wires 8. The cutting of the fibers by knife 28 forms two rows of fiber elements, each of which is claimped between its wire 2 or 4 and one of the holding wires 8, and each of those combinations is referred to as a "wire-fiber assembly" or "workpiece" 6. Workpieces 6 are drawn through an arc of the order of 90° around their respective pulleys 24 or 26 and thence in opposite directions away from pulleys 24 or 26, i.e., radially outwardly with respect to axis 23, and each workpiece passes to a pulley 30 (see also FIG. 3) of a transfer assembly 32 (FIG. 2). As indicated above, the two workpieces 6 are treated separately but identically. The workpiece 6 which includes wire 2 and which passes to the left in FIG. 2 will now be discussed, it being understood that the other workpiece is provided with identical mechanism and is treated identically. Transfer assembly 32 has a second pulley 34 and a rotatably-mounted spindle or guide pin 36 positioned between those pulleys. Pulley 30 has a flange 38 (see also FIG. 4) which forms a ledge 40 above which there is a cylindrical surface 42. Holding wire 8 is drawn from pulley 24 toward the juncture of ledge 40 and surface 42, between pin 36 and pulley 30. As will be explained more fully below, wire 8 then clamps the lower end portions of the fibers against surface 42. However, wire 2 is drawn away from wire 8 and the fiber elements along the other side of pin 36 directly to pulley 34, and it passes around pulley 34 through an arc of the order of 270°. It then returns to pulley 30 along a path between pin 36 and pulley 30. Thus, wire 2 is formed into a "free loop" along a separate path away from wire 8 and the fiber elements 15. However, wire 2 is held against wire 8 as the workpiece passes from pulley 24 to the position in which the fiber elements are clamped against pulley 34 by wire 8. The returning or downstream end of the free loop of wire 2 moves back into engagement with pulley 30 and wire 8 while the fibers are still held against pulley 30 by wire 8.

Figures 1, 4:
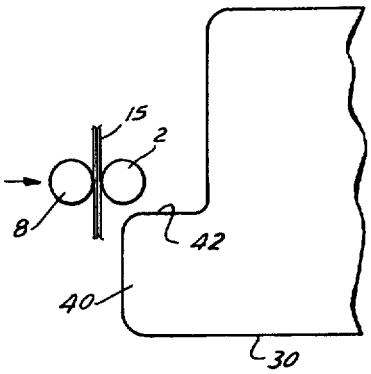
FIGS. 4.1–4.6 are a group of schematic views on the lines indicated by FIG. 3 by the double-digit lines 1 to 6, inclusive.
Figure 4:
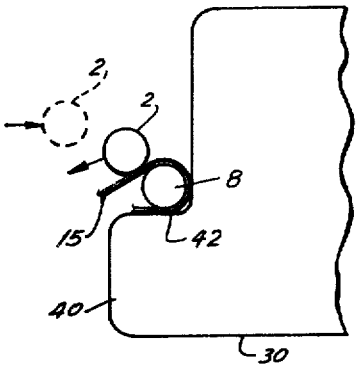
Figures 2, 4:
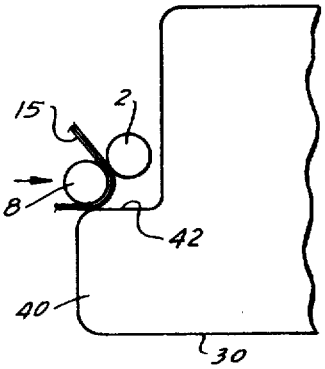
Figures 4, 5:
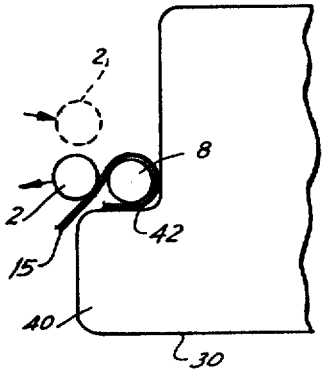
Figures 3, 4:
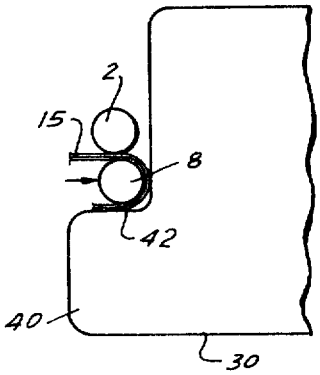
Figures 4, 5, 6:
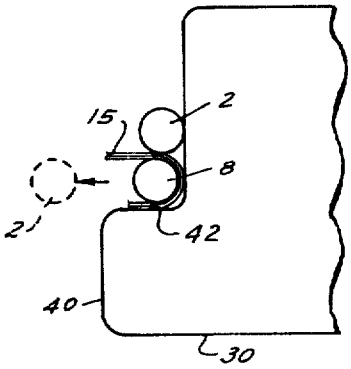

The arrangement is such that wires 2 and 8 are twisted into a partial spiral between pulley 24 and pulley 30, and that partial spiral relationship insures that the fibers will be clamped securely between the wires. It Is thus seen that the fibers are clamped in their side-by-side parallel relationship from the zone of the knife where they are formed to the position where the forward end of the free loop of wire 2 moves back into clamping relationship with wire 8. The various views of FIG. 4 illustrate the specific relationship between the wires and pulley 30 throughout the critical zone in which wire 2 moves away from and back to wire 8 to pass through its free loop. As will be explained more fully below, an important aspect of the invention is to divert one wire of the wire-fiber assemblies through a free loop away from the other wire while insuring that the continuous array of fiber elements are held in the proper relationship with respect to the other wire.

Figure 3:
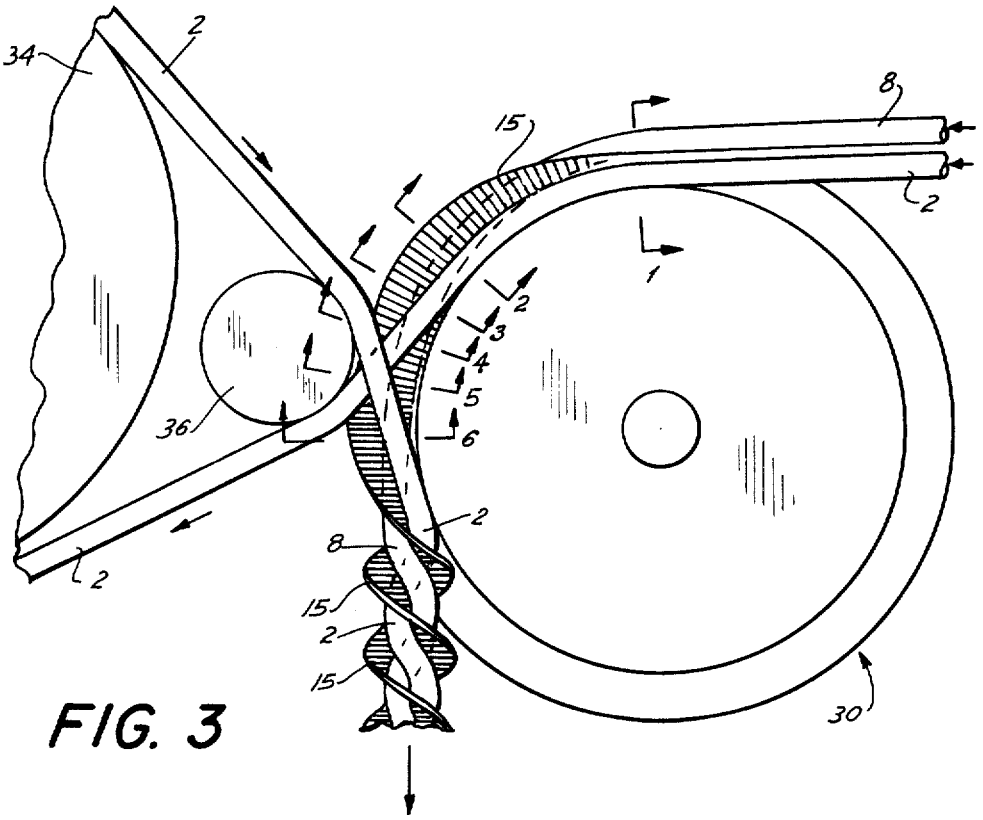
FIG. 3 is a greatly enlarged plan view of a portion of the transfer assembly which isolates the cutter assembly from the twisting zone.

FIG. 4 illustrates the relationship between the two wires and the row of fiber elements through the zone in which wire-fiber assembly 6 approaches pulley 30 and wire 2 moves away from the wire 8 and the fiber elements and the zone in which wire 2 returns to pulley 30. The six portions of FIG. 4 are identified as diagrams 4-1 to 4-6 respectively. In 4-1, the wire-fiber assembly has not contacted pulley 30, but wire 8 is being drawn toward pulley 30, although wire 2 is closer to the pulley. In 4-2, wire 8 is still being drawn toward pulley 30, but wire 2 is being drawn away from pulley 30 toward pulley 34. In 4-3, wire 8 has moved in against surfaces 40 and 42 of pulley 30 and has clamped the fiber elements against ledge 40 and cylindrical surface 42. To this point, wires 2 and 8 are held against each other and up to this zone have continued to clamp the row of fiber elements between them. In 4-4, wire 8 continues to hold the fiber elements against the surfaces of pulley 30 and wire 2 has moved away from the fiber elements. Referring to FIG. 3, wire 2 is drawn to and around pulley 34 and then returns to pulley 30, and that return is indicated by the broken-line representations of wire 2 in 4-4 and 4-5. In 4-6, wire 2 is moved in against surface 42 of pulley 30 and is drawn downwardly so that it again clamps the fiber elements against wire 8. Therefore, wire 8 has continued to clamp the fiber elements against surfaces 40 and 42 of pulley 30 throughout the zone along the pulley within which wire 2 moves away from through its free loop and returns to its fiber-clamping relationship with wire 8.

As shown in FIG. 2, the wire-fiber assembly is drawn in taut condition between pulley 30 and its twisting head 12. Hence, the wire-fiber assembly moves tangentially from the cylindrical surface 42 of pulley 30. (See 4-6 of FIG. 4 and FIG. 3). As the wire-fiber assembly is drawn clockwise (FIG. 3) around surface 42, the two wires move together with wire 2 directly above wire 8. The twisting action is clockwise when looking upstream so that wire 2 is drawn in against surface 42 and between that surface and wire 8. Wire 8 is simultaneously urged toward surface 42 by its upstream portion which is held against surface 42, and by its downstream portion because of the "clockwise" twisting action. It is thus seen that the two wires are twisted together within a very limited arc along surface 42. The rate of twisting is such as to insure the desired pitch in the twisted wires. The twisting action clamps the fiber elements very tightly so that they project generally radially outwardly from the axis of the spiral wire-fiber assembly.

When the wire-fiber assemblies are being formed, the holding wires move against the opposite sides of wires 2 and 4, as discussed above. That causes each fiber element to be clamped by its wires at its longitudinal central portion as shown in FIG. 3 and in 4-1. As wire 8 moves in below wire 2 in 4-2, it engages the lower portion of each fiber element and clamps that lower portion against surfaces 40 and 42. Each fiber element is held in that fixed relationship between the pulley surfaces and wire 8 throughout the zone in which wire 2 moves away to its free loop and then returns as shown in 4-6. Hence, each fiber element is again clamped at its longitudinal central portion so that the array of fiber elements extends evenly from the opposite sides of the center axis of the finished workpiece.

As indicated above, the finished workpiece is drawn through the twisting head and is fed out along the head axis. Cutter 14 cuts the workpiece into predetermined lengths to form the pipe cleaner.

The invention contemplates that the exact relationship between the wires can be varied, and that other modifications and embodiments may be provided, all within the scope of the invention as set forth in the claims.

The word "wire" is used in the broad sense of a thin rod or the like. However, the material must be such that it is bendable but it must retain the twisted configuration so as to clamp the fiber elements.

What is claimed is:

1. Apparatus for producing pipe cleaners and the like each of which includes a pair of wires which are twisted together with a row of transversely positioned cleaner fibers clamped between the wires with their ends exposed, wherein the apparatus includes means to pass two primary wires in parallel side-by-side relationship through a spinning head which is rotated about a fixed axis and which winds one or more continuous strands of fibers spirally around said wires, and wherein said wires with the spirally-wound fibers then pass to cutter means positioned in a cutting zone symmetrically positioned relative to the axis of the spirally-wound fibers as said wires emerge along said axis from said spinning head, and wherein said cutter means cuts said fibers diametrically of said axis whereby each complete spiral of the fibers is formed into two substantially equal lengths of fibers and thereby forms two rows of fibers positioned respectively upon the opposite sides of said primary wires, and wherein there is means which directs two holding wires to said cutting zone from substantially opposite directions with each of said holding wires moving adjacent a respective one of said primary wires to thereby clamp the respective one of said rows of fibers against its primary wire whereby each of said primary wires and one of said holding wires clamps one of said rows of fibers, thereby to form two wire-fiber assemblies each of which comprises one of said rows of fibers and two mating wires comprising one each of said primary wires and said holding wires which mate with the row of fibers clamped between the wires, the improvement which comprises, means to pass each of said wire-fiber assemblies radially outwardly from said axis in substantially diametrically opposite directions with each of said wire-fiber assemblies moving to a transfer zone, holding means at each of said transfer zones supporting its wire-fiber assembly and moving one of the said wires of that assembly through a free loop away from its mating wire and its row of fibers at said transfer zone and thence back to said transfer zone and back into contact with the said fibers to thereby reconstruct the said wire-fiber assembly while simultaneously pressing the assembly in the axial and radial direction in said transfer zone, said holding means including a pulley having a cylindrical surface and a flange which defines a ledge surface extending radially outwardly from the cylindrical surface and against which said mating wire holds the fibers in said transfer zone while said one wire moves through said free loop, and two separately operating twisting-head assemblies, each comprising a twisting-head asembly, one for each of said wire-fiber assemblies, each of which is positioned a predtermined distance from the respective transfer zone to thereby form a twisting zone between each transfer zone and its twisting head assembly with the said twisting head-assembly holding its wire-fiber assembly taut within said twisting zone and simultaneously twisting the wire-fiber assembly and with the twisting of the wire-fiber assembly being confined to said twisting zone by said free loop of the respective one of the said wires.

2. Apparatus for producing rod-fiber assemblies, each of which includes two bendable rods which are twisted into interlocking spirals with fiber elements clamped at their longitudinal central portions between the rods, which incoudes, means to produce a workpiece comprising two rods which are drawn together along a predetermined path with an array or transverse fibers with their longitudinal center portions positions between and clamped by the rods, means to twist said rods into continuous interlocking spirals comprising, a pulley having an annular peripheral surface and a flange which defines a ledge surface extending radially outwardly from said peripheral surface and against which one of the rods of said assembly is pressed simultaneously in an axial direction and radially inwardly with respect to the pulley axis with the rod moving against each fiber element at one side of said central portion thereof whereby the fiber element is clamped against said ledge surface of the pulley, means for moving the other rod of said assembly tangentially away from said pulley whereby said fiber elements are held in their predetermined parallel relationship between said one rod and said ledge surface of said pulley while moving through a predetermined arc on said pulley, means to direct said other rod tangentially toward said surface at the downstream limit of said arc and against said central portions of said fiber elements to re-form a clamping relationship with said one rod to produce a re-formed rod-fiber assembly, and means to hold said re-formed rod-fiber assembly in taut relationship and to draw it from said pulley and to twist said rod-fiber assembly at a controlled rate whereby the rods forming said re-formed rod-fiber assembly are twisted into continuous interlocking spirals within the zone where they move from said pulley.

3. Apparatus as described in claim 2, wherein said rods are metal wires and wherein said other rod forms a free loop when moving away from said pulley and the other end of said free loop constitutes said rod which is moved tangentially to said pulley.

4. The method of producing pipe cleaners which includes the steps of, producing a rod-fiber assembly formed by two rods which are held in close side-by-side relationship and a continuous array of fiber elements which are clamped between said rods and held in substantially parallel relationship, moving said assembly to the surface of a pulley having a flange and a radial surface while drawing one of said rods against said flanged pulley with said array of fiber elements being clamped between the flanged surface of said pulley and the rod, moving the other of said rods away from said one rod within the upstream edge of the arc on said pulley within which said fiber elements are clamped against said pulley; drawing said other rod around a free loop and thence back to said pulley tangentially with respect to the path of said one of said rods to thereby produce a re-formed rod-fiber assembly on said pulley, and twisting said re-formed rod-fiber assembly at a rate relative to its longitudinal movement to form said rods into interlocking spirals holding said fiber elements between them.

5. The method as described in claim 4, wherein said one of said rods is drawn against said pulley to produce forces axially and radially inwardly with respect thereto, and said other rod is drawn toward said pulley and thence between said one rod and said pulley by the twisting action, whereby the rods are twisted within the zone in which said rods move together away from said pulley.

6. In apparatus for twisting a wire-fiber assembly which includes a pair of wires with a row of fiber elements between them to form a continuous workpiece comprising interlocked continuous spirals with the ends of the fiber elements projecting outwardly, the combination of, a pulley having a cylindrical surface and a flange which forms a ledge surface which extends radially outwardly from said cylindrical surface, and means defining a loop path having an axis parallel to the axis of said pulley and positioned adjacent said pulley whereby said wires can be passed onto said pully in parallel relationship and passed therealong through a predetermined arc with one of said wires moving into contact with said cylindrical surface and with said ledge to thereby clamp the said fiber element against said pulley and whereby the other of said wires is passed from said pulley and along said loop path and thence back to said pulley and against said cylindrical surface and against said one of said wires upon the side thereof opposite the side adjacent said ledge, and means to draw said wires away from said pulley in taut condition and to simultaneously twist said spiral wire-fiber assembly at its leading end with said other of said wires being thereby drawn between said cylindrical surface and said one of said wires and immediately thereafter between said ledge and said one of said wires with the rate of the twisting action being related to the rate of movement of said wires onto said pulley such that the desired continuous interlocking spirals are formed by said wires with said fiber elements clamped therebetween.

7. Apparatus as described in claim 6 wherein said means forming the loop path comprises a rotatable pulley around which said other wire passes.

8. Apparatus as described in claim 7 which includes a rotatable spindle positioned between said pulleys and with said other of said wires passing between said spindle in the first-named of said pulleys and moving to and from the second-named of said pulleys.

* * * * *